US008707647B2

(12) United States Patent
Crego

(10) Patent No.: US 8,707,647 B2
(45) Date of Patent: Apr. 29, 2014

(54) SINGLE-PLY ROOFING SYSTEM

(75) Inventor: Thomas Crego, Rio Rancho, NM (US)

(73) Assignee: Crego Metal Systems, Inc., Albuquerque, NM (US)

( * ) Notice: Subject to any disclaimer, the term of this patent is extended or adjusted under 35 U.S.C. 154(b) by 233 days.

(21) Appl. No.: 12/634,415

(22) Filed: Dec. 9, 2009

(65) Prior Publication Data

US 2010/0083589 A1 Apr. 8, 2010

Related U.S. Application Data

(63) Continuation-in-part of application No. 11/925,601, filed on Oct. 26, 2007, now abandoned.

(60) Provisional application No. 60/891,367, filed on Feb. 23, 2007.

(51) Int. Cl.
*E04B 5/00* (2006.01)

(52) U.S. Cl.
USPC ..... 52/408; 52/394; 52/409

(58) Field of Classification Search
USPC ..... 52/58, 300, 394, 408–410, 588.1
See application file for complete search history.

(56) References Cited

U.S. PATENT DOCUMENTS

| | | | | |
|---|---|---|---|---|
| 1,148,647 | A * | 8/1915 | Yetter | 52/549 |
| 3,320,707 | A | 5/1967 | Berg | |
| 4,065,906 | A | 1/1978 | Mears | |
| 4,071,994 | A | 2/1978 | Ammann | |
| 4,075,807 | A | 2/1978 | Alderman | |
| 4,617,770 | A | 10/1986 | Hickman | |
| 4,619,100 | A | 10/1986 | Emblin | |
| 4,649,684 | A | 3/1987 | Petree et al. | |
| 4,741,132 | A | 5/1988 | Emblin | |
| 4,864,781 | A * | 9/1989 | Emblin | 52/58 |
| 5,189,853 | A | 3/1993 | Braine et al. | |
| 5,367,848 | A * | 11/1994 | McConnohie | 52/336 |
| 5,394,672 | A | 3/1995 | Seem | |
| 5,605,020 | A * | 2/1997 | Chambers | 52/58 |
| 6,354,045 | B1 | 3/2002 | Boone et al. | |
| 6,883,760 | B2 | 4/2005 | Seise, Jr. | |
| 7,963,081 | B2 * | 6/2011 | Pierson et al. | 52/461 |
| 8,024,906 | B1 | 9/2011 | Nelson et al. | |
| 8,127,512 | B2 | 3/2012 | Pierson | |
| 2002/0178671 | A1 * | 12/2002 | Gembala | 52/302.6 |
| 2004/0103592 | A1 * | 6/2004 | Edvardsen | 52/58 |
| 2009/0229209 | A1 | 9/2009 | Crego | |

FOREIGN PATENT DOCUMENTS

| | | |
|---|---|---|
| DE | 2203310 | 8/1973 |
| DE | 3531910 | 3/1987 |
| GB | 2230284 | 10/1990 |
| JP | 05-012527 | 1/1993 |
| JP | 2001003461 | 1/2001 |
| WO | WO 79/01138 | 12/1979 |

* cited by examiner

*Primary Examiner* — Brian Glessner
*Assistant Examiner* — Adam Barlow
(74) *Attorney, Agent, or Firm* — Justin R. Jackson; Deborah A. Peacock; Peacock Myers, P.C.

(57) ABSTRACT

A roofing system for application on a roofing substrate wherein flexible supports alleviate fatiguing of the roofing sheeting which typically occurs due to thermal expansion and contraction, thus enabling thicker roofing sheeting to be used and thus extending the usable life of the roofing sheeting.

9 Claims, 20 Drawing Sheets

SINGLE-PLY ROOFING SYSTEM

CROSS-REFERENCE TO RELATED APPLICATIONS

This application is a Continuation-In-Part patent application of U.S. patent application Ser. No. 11/925,601, entitled Single Ply Roofing System, which itself claims priority to U.S. Provisional Patent Application Ser. No. 60/891,367, entitled "Single Ply Metal Roofing System", filed on Feb. 23, 2007, and the specifications thereof are incorporated herein by reference.

BACKGROUND OF THE INVENTION

1. Field of the Invention (Technical Field)

The present invention relates to a method and apparatus for a metal roofing system. Particularly, the present invention relates to an improved single ply metal roofing system which permits the use of thicker sheeting than the prior art while solving thermal expansion and contraction issues which plague the prior art systems.

2. Description of Related Art

Known metal roofing systems permit only a maximum thickness of 30 gauge metal-sheeting to be applied to a roof. Such known systems rely on "hat" channel 2 disposed on a roofing substrate, (see prior art FIG. 1). The sheeting is screwed into the hat channel which fixedly holds the sheeting in place and prevents if from moving. Securing the sheeting to an inflexible member, such as a hat channel, prevents the sheet metal from being able to expand and contract with thermal cycling. Thermal expansion and contraction forces on the sheeting increase as the thickness of the metal increases. Accordingly, known systems cannot apply thicker and more substantial sheeting because thermal expansion and contraction occurs which results in excessive expansion and contraction of the metal. The excessive expansion and contraction of such metal-sheeting results in excessive forces being applied to the fasteners that are driven through it. These excessive forces cause the fasteners to either become loose or cause the sheeting to pull away from the fasteners; either of these scenarios results in a loose fit between the fastener and the sheeting, thus permitting water to pass between the fastener and the sheeting, thereby breaching the surface of the roof.

Because the known metal roofing systems are limited to a maximum thickness of only about 30 gauge, those systems are easily punctured. For example, puncturing may occur by a worker simply dropping a screwdriver during installation or dropping a tool while performing any other work on a roof, i.e. repairing a heating, ventilation, and air conditioning unit. Accordingly, a quick patch is not at all uncommon and such patches themselves often result in point of water entry several years later.

Yet another problem with known single ply roofing systems is that the roofing sheets are held to the top of the structure by screwing the edges of the roofing sheets onto hat channels that are disposed on the top of the structure. The hat channels themselves are modified, non-flexible, channel-iron members which rigidly and fixedly hold the roofing sheets in place. When the roofing sheets expand and contract, because their edges are held firmly held in place, the roofing sheets must thus bow up in their central region. This continuous rising and falling of the central portion of each of the sheets in response to thermal expansion and contraction, coupled with the row of fasteners around the periphery thereof, results in metal fatiguing of the roofing sheets along the inside edge of the metal fasteners. Over time, the constant cycling of thermal contractions and expansions thus causes the breaks in the roofing sheets which thus enables water to breach the roofing surface. Because even thicker roofing sheeting experiences even greater expansion and contraction cycles, attempts to secure thicker sheeting to the known hat channels results in even more extreme rising and falling of the central portion of the sheets in response to the thermal expansions and contractions. This extreme rising and falling of the sheets results in metal fatiguing of the roofing sheeting in a much more rapid manner than what is typical.

Although insulating sheeting can and often is applied between the hat channels immediately below the roofing sheeting, the space beneath the hat channels typically remains un-insulated. Because the air within the un-insulated metal hat channels is exposed to warm and cold temperature cycles, condensation often forms along the inside of the hat channels. This condensation often results in non-protected metal surfaces rusting (i.e. the fasteners that are driven through the hat channels and which hold the sheeting thereto). The rusting of the very components that hold the metal roofing structures together is obviously a very undesirable quality in the known metal roofing structures.

Known metal roofing systems also provide undesirable flashing. This is because the flashing that is used to trim outer portions of known roof structures do not have an interlocking structure that adequately prevents water from blowing, splashing, or otherwise traveling therebetween, thus resulting in water breaching the roofing surface. Known metal roofing systems typically rely on a two-piece flashing arrangement wherein the upper portion of the flashing extends slightly beyond the lower portion. This simple overlap joint does not provide an effective seal in all instances.

There is thus a present need for a single ply metal roofing system which permits a thicker sheeting to be applied and which avoids metal fatiguing of the roofing sheeting and which further avoids the use of metal structures that permit condensation to form therein. There is also a present need for a metal roofing system that provides flashing which effectively prevents splashing and wind-driven rain from breaching the roof surface. There is yet another present need for a metal roofing system that more adequately resists puncturing of sheet metal while it is being installed and while other roof work is subsequently performed.

BRIEF SUMMARY OF THE INVENTION

An embodiment of the present invention relates to a roofing system for an existing roofing substrate having at least one flexible support, the flexible support attached to the roofing substrate, and at least one layer of sheeting, the sheeting attached to the flexible support such that the flexible support flexes when the sheeting thermally expands and/or contracts. The insulating materials can be disposed above the roofing substrate and below the sheeting. The insulating materials can have a thickness of about 1 inch or more. In one embodiment, the sheeting is preferably a metal material and most preferably a steel material.

In one embodiment, at least a portion of the sheeting can comprise a thickness of from about 31 gauge to about 22 gauge, and most preferably a thickness of about 26 gauge. A waterproofing material can be disposed between overlapping portions of the sheeting.

In one embodiment, the roofing system of the present invention comprises at least one fastener.

In one embodiment, the roofing system of the present invention preferably comprises a lower flashing component fastened to an upper surface of the sheeting and an upper flashing component fastened to an at least substantially vertical surface. The upper and lower flashing components most preferably interlock to form a slidable connectable therebetween.

Embodiments of the present invention also optionally comprise at least one expansion joint.

An embodiment of the present invention relates to a method of installing a roofing system on a roofing substrate including attaching at least one flexible support to an upper portion of the roofing substrate and fastening a portion of a first sheeting at least partially onto an upper portion of the flexible support member. The method can also include disposing a portion of a second sheeting at least partially onto an upper surface of the first sheeting and/or disposing one or more insulating materials above the roofing substrate and abutting at least one of the insulating materials to at least one of the flexible support structures. In one embodiment of the present invention, the method can include fastening the lower flashing component to an end portion of the at least one layer of sheeting and fastening the upper flashing component to a wall, which can also further include slidably connecting the lower flashing component to the upper flashing component. Optionally, the method can also include installing at least one expansion joint.

The method can also include disposing a waterproofing material between at least some of the overlapping portions of the first and second sheeting. In the method, one or more coatings of material can be applied onto at least a portion of the sheeting.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Embodiments of the present invention are directed to a metal roofing system. Particularly, embodiments of the present invention are directed to a metal roofing system which simultaneously provides thicker roofing sheeting and allows for thermal expansion and contraction without the adverse effects which are common to conventional systems.

Although the present invention is particularly directed toward metal roofing systems, the teachings of the present invention are not limited strictly to metals and can provide desirable results when used with other materials including but not limited to coated metals, metal alloys, composites, plastics, rubbers, fiberglass, other solid materials that are water resistant, combinations thereof, and the like. Accordingly, the terms "sheeting" and "flexible support" as used throughout the specifications and claims is intended to include all of these materials.

As used throughout the specification, the term "wall" is not limited strictly to the conventionally-defined wall, but rather, includes any surface or structure which a user wishes to bridge to the sheeting of the present invention with one or more flashings.

Figure 11:
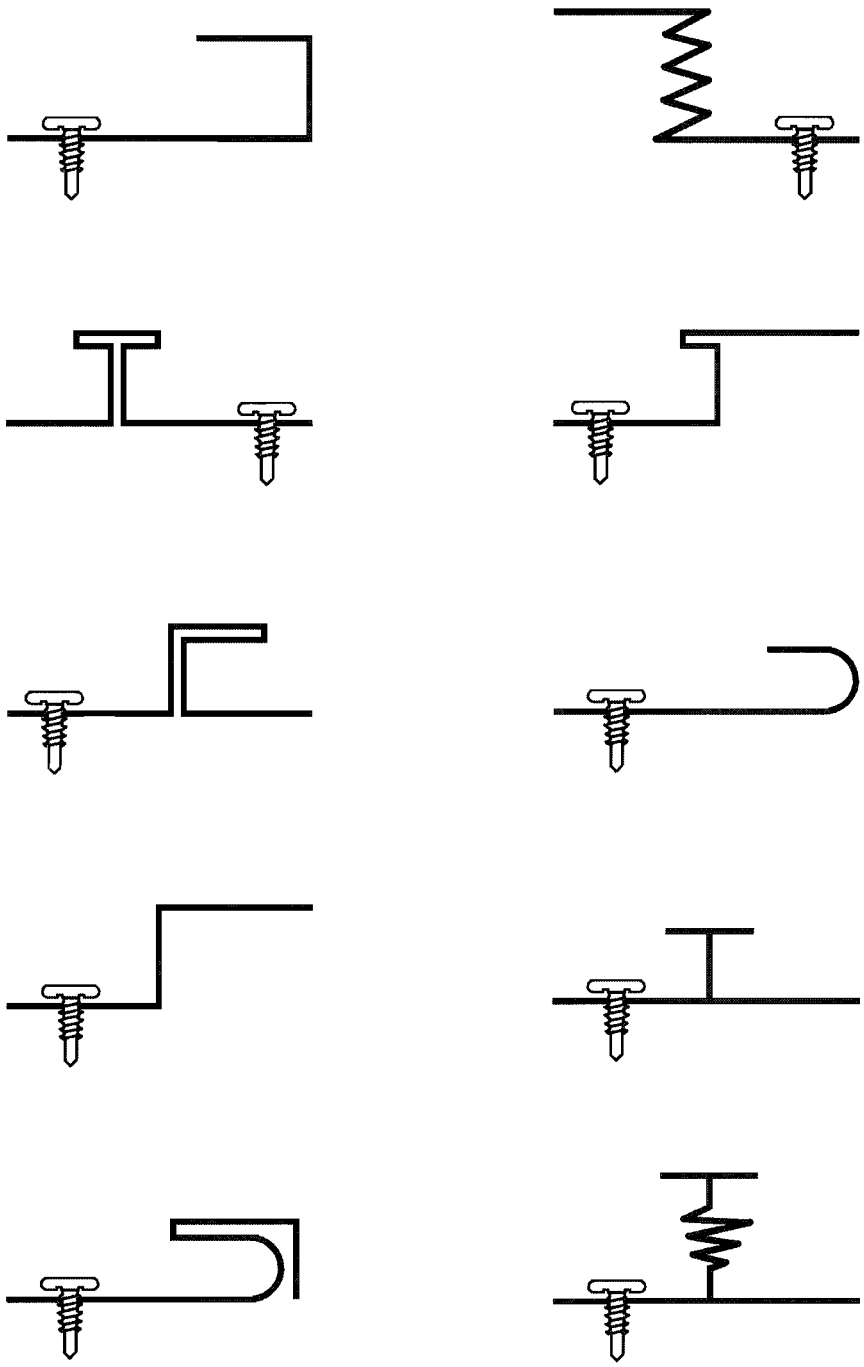
FIG. 11 is a drawing illustrating some of the possible design shapes for flexible support members of the present invention.

As used throughout the specification, the term "flexible support" includes all structures that flexibly bend and give in a manner which accommodates expansion and contraction of sheeting fixed thereto and can include any of the shapes illustrated on FIG. 11 and the like. As illustrated in FIG. 11, the flexible supports of the present invention preferably comprise an upper surface which extends beyond and thus overhangs one or more supporting upright portions thereof. Accordingly, the term "flexible support" does not include a hat channel disposed with its opening facing a roofing substrate as is used in the prior art.

Figure 1:
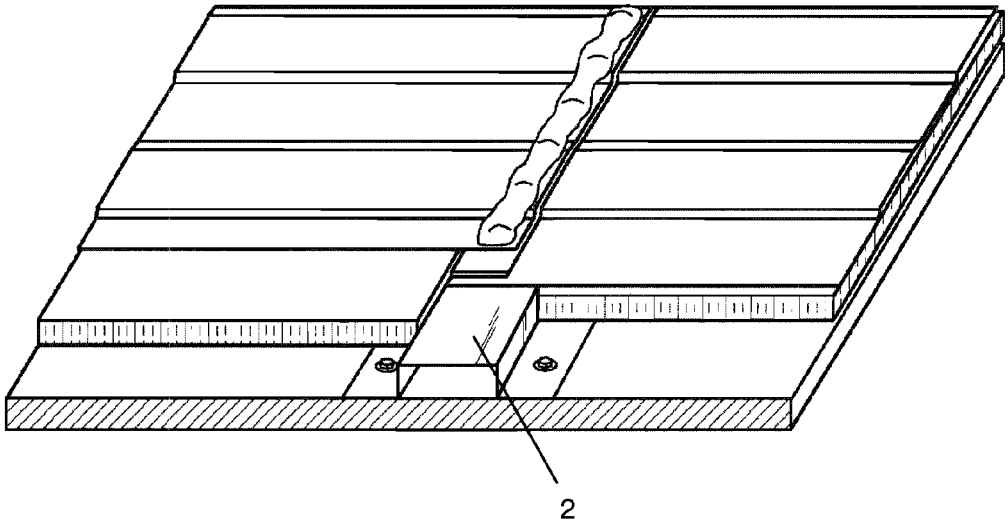
FIG. 1 is a cut-away view drawing of a prior art metal roofing system.
Figure 2:
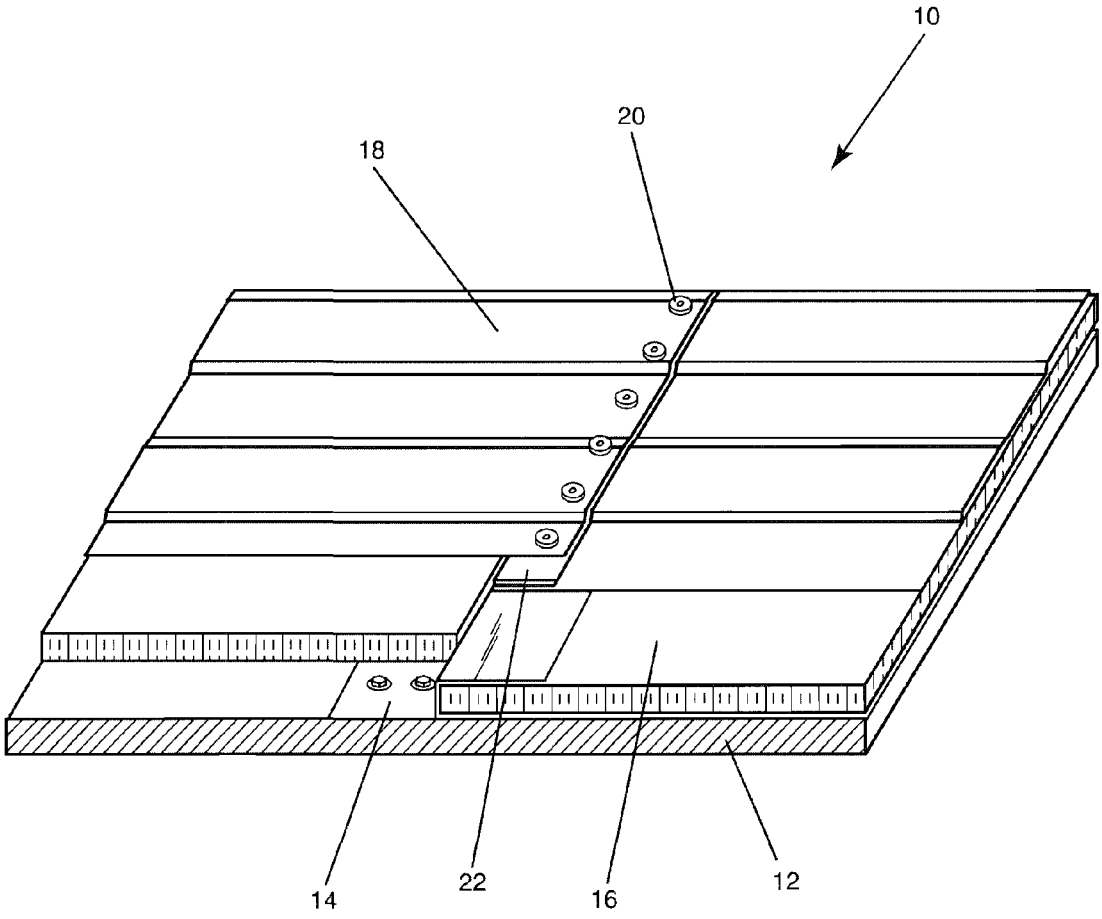
FIG. 2 is a cut-away view drawing illustrating an embodiment of the single ply metal roofing system of the present invention.
Figure 3:
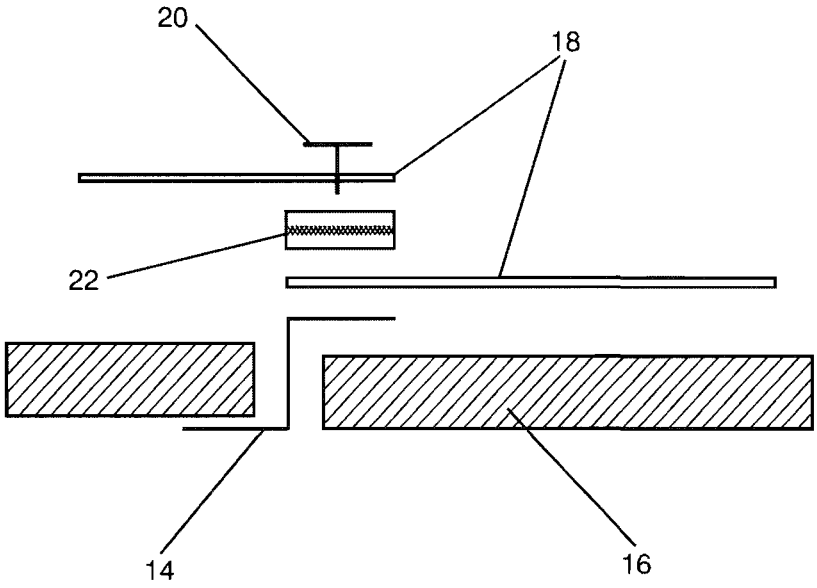
FIG. 3 is an exploded view schematic drawing illustrating an embodiment of the present invention.
Figure 4:
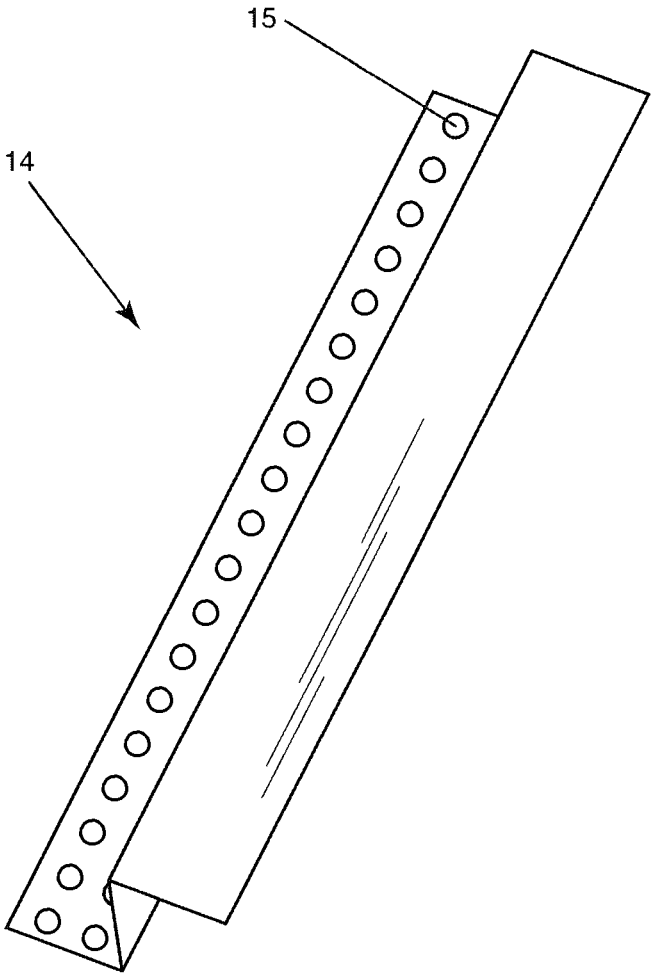
FIG. 4 is a perspective view of a Z-shaped flexible support according to an embodiment of the present invention.

As illustrated in FIGS. 2 and 3, an embodiment of the present invention is directed to roofing system 10, which is most preferably a single ply roofing system. Roofing substrate 12 preferably has flexible support 14, which is also preferably metal, attached thereto. While roofing substrate 12 is most preferably a solid and flat surface, roofing substrate 12 can be formed from spaced apart beams. Attachment of flexible support 14 can be made to roofing substrate by fasteners and/or fastening methods known to those skilled in the art, including but not limited to, welding, riveting, screwing, nailing, gluing, combinations thereof, and the like. Flexible support 14 preferably has a plurality of fastener holes disposed along a length thereof for attachment to roofing substrate 12. Providing two or more holes at predetermined distances along a primary length of flexible support 14 enables an installer to attach flexible support 14 to substrate 12 more securely in that installers are less likely to install a single row of fasteners, which could otherwise enable flexible support 14 to rock back and forth, thus eventually loosening a single row of fasteners. Further, providing holes at predetermined distances helps to ensure that an installer of the roofing system will insert fasteners at the location of the holes and thereby helps to ensure that the fasteners are installed through the flexible supports at specified locations, thus improving installation consistency and quality. While not essential, one or more insulating materials 16 are preferably disposed above substrate 12 and abut flexible support 14. In a most preferred embodiment, insulating materials 16 preferably comprise an expanded or extruded polystyrene foam material. In yet another preferred embodiment, insulating materials 16 are preferably at least 1 inch thick or have a thickness of about the height of flexible support 14. Insulating materials 16 can also preferably include a lap joint or some other type of joint so each insulating piece locks together or partially overlaps one another, which avoids butting two pieces of insulation together which can result in a small gap at the joint that has no insulation.

Sheeting 18 is preferably disposed at least partially on top of flexible support 14 and is fastened thereto via one or more fasteners 20. As previously discussed, sheeting 18 can be constructed from virtually any rigid, semi-flexible, or flexible material depending upon the particular environment, application, and results to be achieved for a particular location as will be apparent to those skilled in the art. In a most preferred embodiment, however, sheeting 18 preferably comprises a metal and even more preferably a steel material. Sheeting 18 can comprise virtually any gauge of thickness, depending upon the application and environment as will become apparent to those skilled in the art upon studying this application. Sheeting 18, however, preferably comprises a thickness of from about 11 gauge to about 36 gauge, and more preferably from about 22 gauge to about 32 gauge. In a most preferred embodiment, sheeting 18 comprises a thickness of about 26 gauge. Although sheeting 18 is illustrated in FIG. 2 as having a patterned surface, sheeting 18 can comprise a flat smooth surface, a rough and/or textured surface, a patterned surface, or another surface, in a most preferred embodiment, sheeting 18 preferably comprises ribs or bends also known as "mesas", disposed along the width of sheet 18, which are about 1/32 of an inch to about 3/8 of an inch in height and which are most preferably about 3/32 of an inch in height.

In a most preferred embodiment, waterproofing material 22, such as for example butyl-tape, rubber stripping, roofing tar, and the like, which preferably has a width of about one inch to about 6 inches, and more preferably has a width of from about 1 inch to about 4 inches, and most preferably a width of about 2 inches, is preferably sandwiched between successive overlapping edge portions of sheeting 18, as best illustrated in the exploded view of FIG. 3. Each consecutive edge portion of sheeting 18 preferably made to overlap directly above flexible support 14. Waterproofing material 22 is also preferably disposed between the overlapping end portions of sheeting 18 directly above flexible support 14. Because each of the overlapping edge portions of sheeting 18 and waterproofing material 22 preferably reside directly above flexible support 14, one or more fasteners 20 can thus be used to secure all of them together.

Although those skilled in the art will appreciate that numerous types of fasteners and fastening methods can be used for fastener 20, in a preferred embodiment, fastener 20 preferably comprises a screw-type fastener, and more preferably a rust-proof screw-type fastener, such as a galvanized screw, a powder-coated screw, a painted screw, and/or a screw made from a rust resistant material.

Because the upper portion of flexible support 14 is not in a rigid and staunch position with respect to the bottom portion, as in the hat channels of the prior art, but can instead easily flex, sheeting 18 attached thereto is thus not rigidly and fixedly secured to roofing substrate 12. Because of the flexible nature of the flexible supports of the present invention, when sheeting 18 expands and contracts due to thermal cycling, and/or high winds, excessive forces are not applied to or around fasteners 20. Because excessive forces are not applied to fasteners 20 from sheeting 18, fasteners 20 do not substantially loosen and thus a water-resistant seal is maintained around them. In addition, because excessive forces are not applied around metal fasteners 20 by sheeting 18, the holes within sheeting 18, through which fasteners 20 pass, do not become enlarged, further enabling the present invention to maintain a water resistant seal. In addition, because the sheeting of the present invention is not rigidly held in place as in the prior art, during expansions and contractions excessive fatiguing of sheeting 18 does not occur.

In one embodiment, flexible support comprises a multi-axial flexible support which has an upper portion that can flex in more than one direction with respect to its lower portion and which upper portion can most preferably can flex not only from side to side, but also up and down with respect to its lower portion. In one embodiment the flexible support and multi-axial flexible support comprises an upper portion which has an end portion which is disposed a distance away from and thus does not reside directly above a substantially perpendicular supporting member of the flexible support and/or the multi-axial flexible support.

Figure 5:
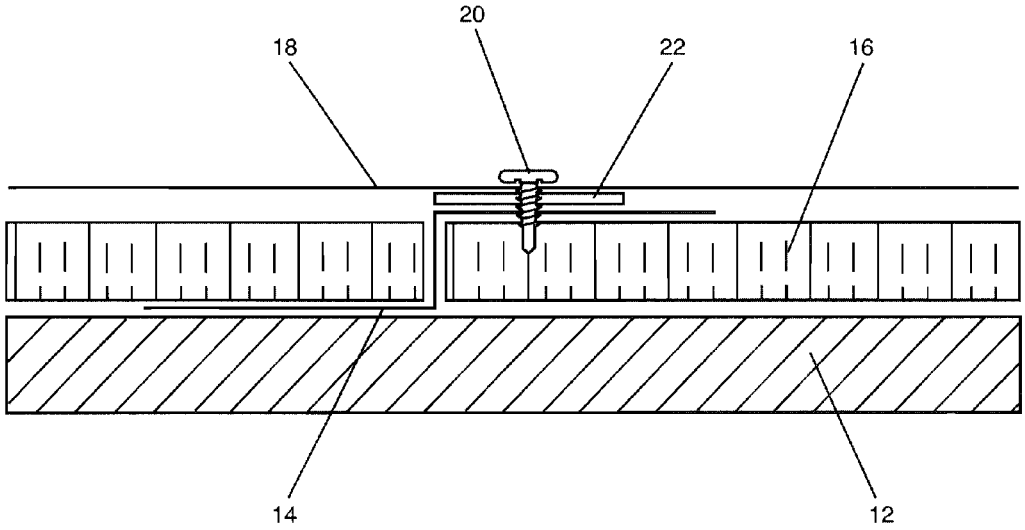
FIG. 5 is a cut-away side view illustrating a blind seam in accordance with an embodiment of the present invention.
Figure 6A:
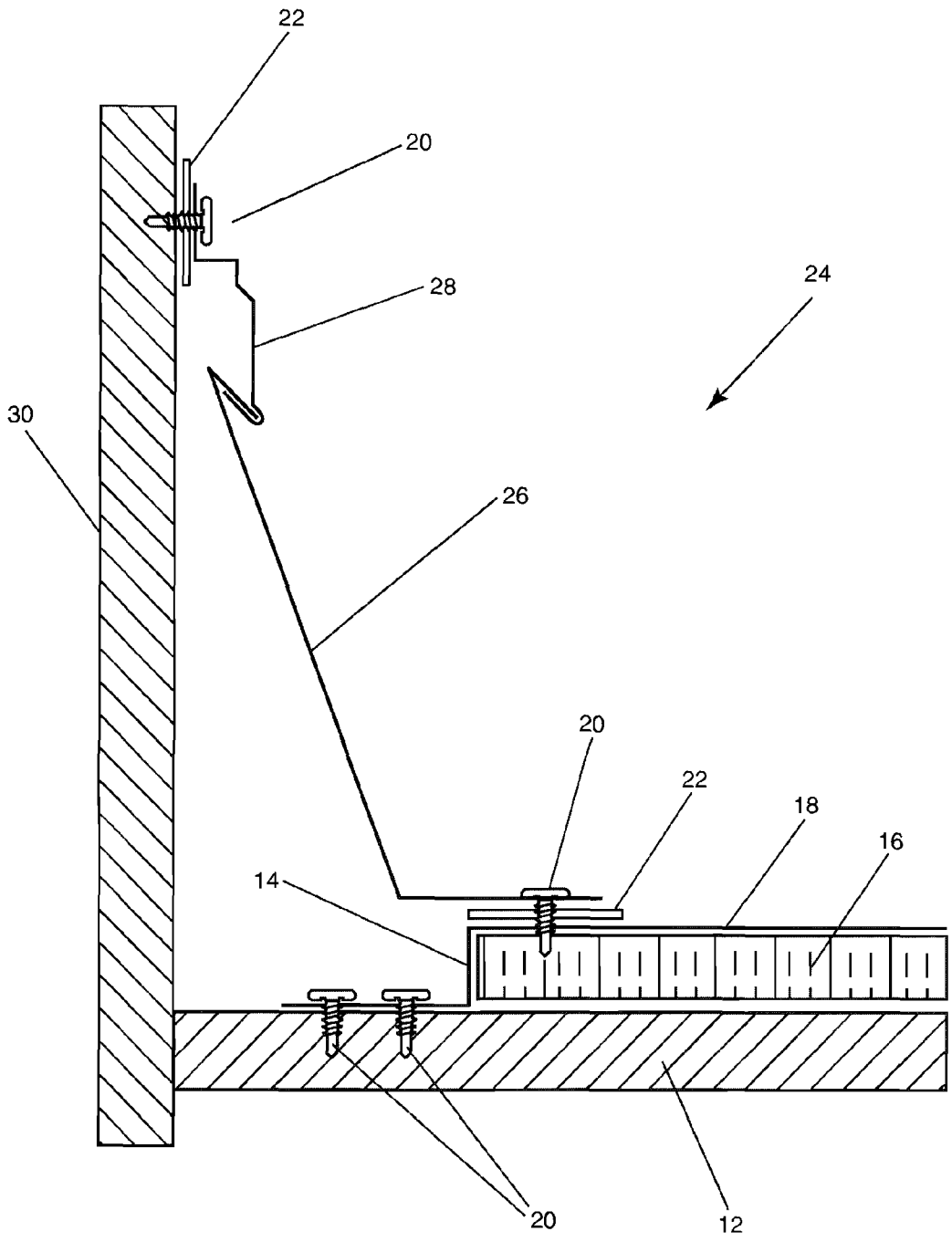
FIG. 6A is a cut-away side view illustrating an embodiment of the flashing of the present invention.
Figure 6B:
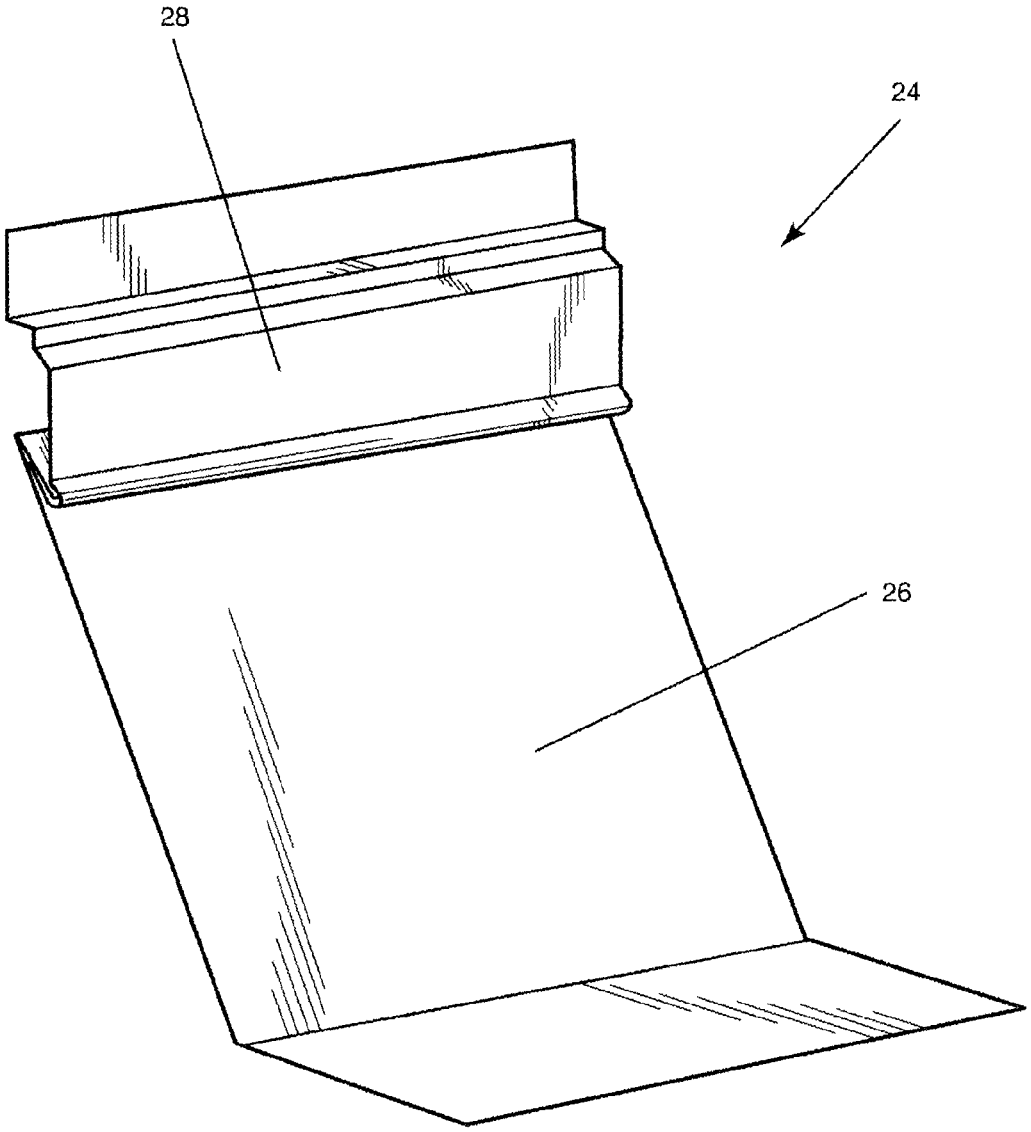
FIG. 6B is a perspective view drawing illustrating an embodiment of the flashing of the present invention.
Figure 6C:
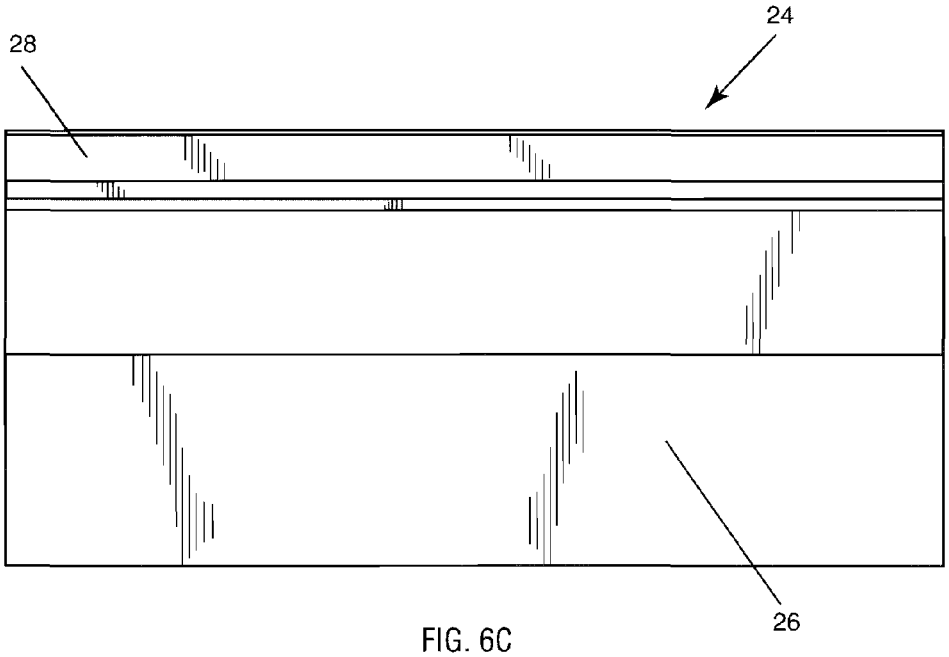
FIGS. 6C and D respectively illustrate top, bottom, views of a most preferred embodiment of the flashing of the present invention.
Figure 6D:
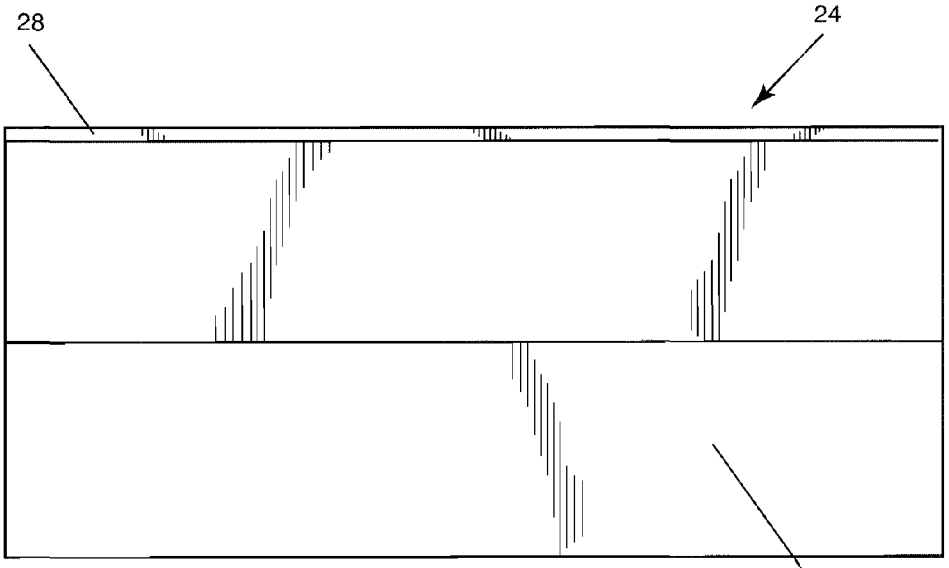
FIG. 6E illustrates a side view of a most preferred embodiment of the flashing of the present invention, in this most preferred embodiment, both of the left and the right side views of the flashing are the same.
FIGS. 6F and G respectively illustrate front and back views of a most preferred embodiment of the flashing of the present invention.
Figure 6E:
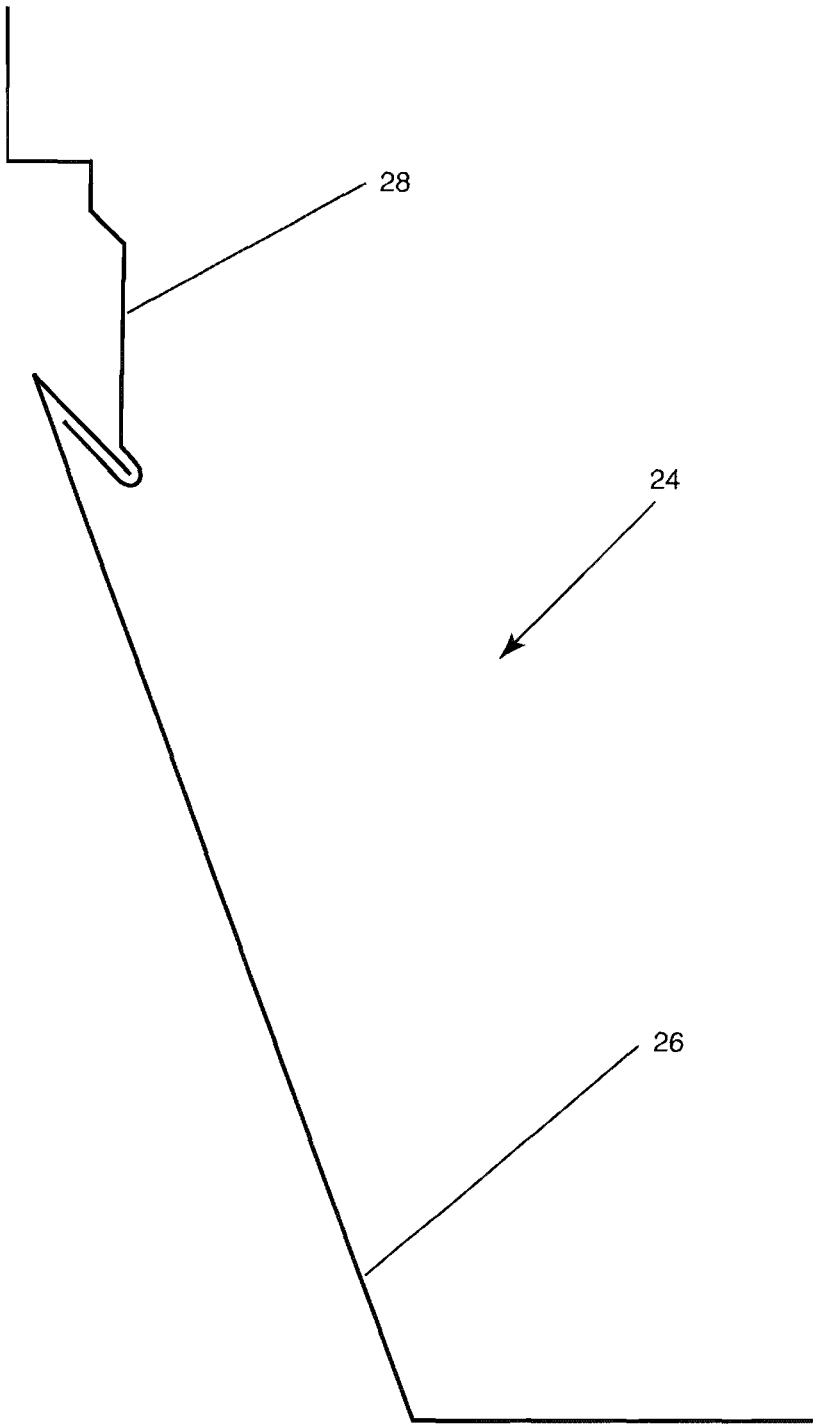
Figure 6F:
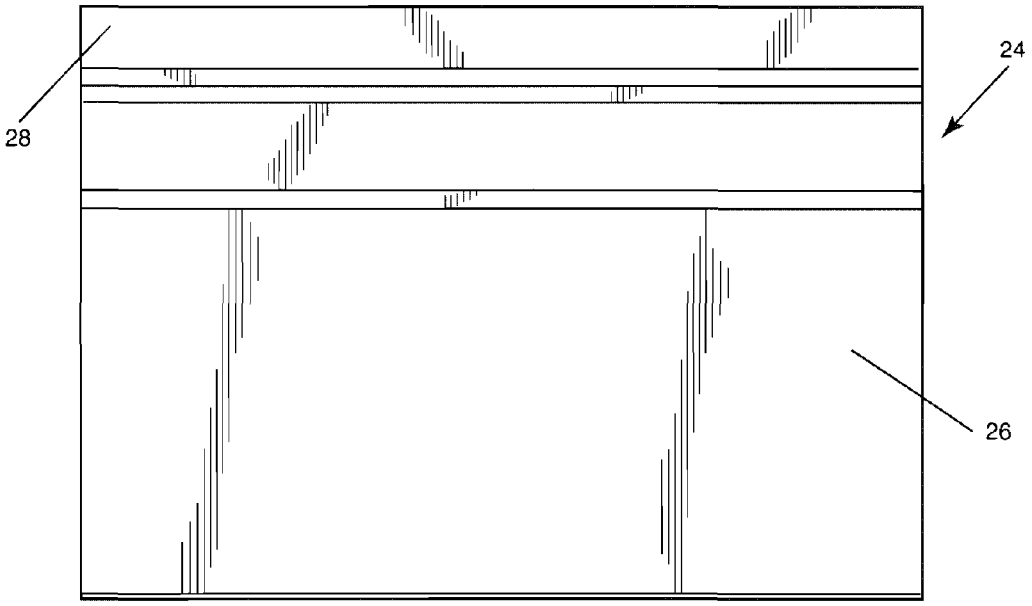
Figure 6G:
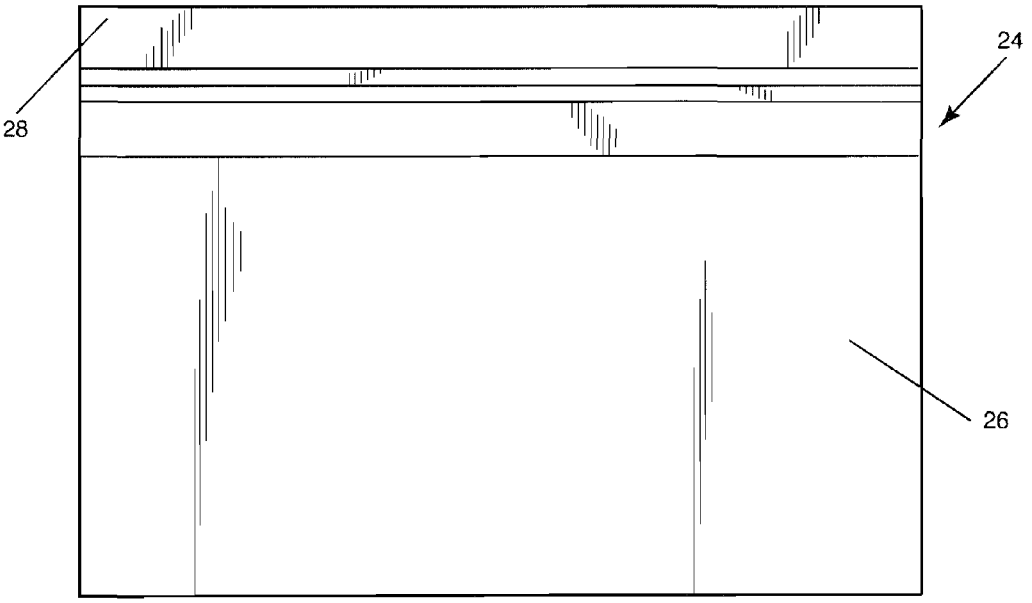

FIG. 5 illustrates a blind seam constructed in accordance with an embodiment of the present invention. As those skilled in the art are aware, a blind seam is typically provided in metal roofing when a change in pitch occurs. Accordingly, blind seams often occur along an inner area of a portion of sheeting and not necessarily along an edge portion thereof. As illustrated therein, insulating materials 16 are preferably cut or otherwise provided such that they terminate at or near the desired location of the blind seam. Flexible support 14 is preferably secured to substrate 12 at the desired location of the blind seam. Insulating materials 16 are thus preferably caused to abut flexible support 14. Waterproofing material 22 is preferably disposed on a top portion of flexible support 14. Sheeting 18 is then preferably positioned above the location of the blind seam and one or more fasteners 20 are used to attach sheeting 18 to an upper portion of flexible support 14.

Figure 7:
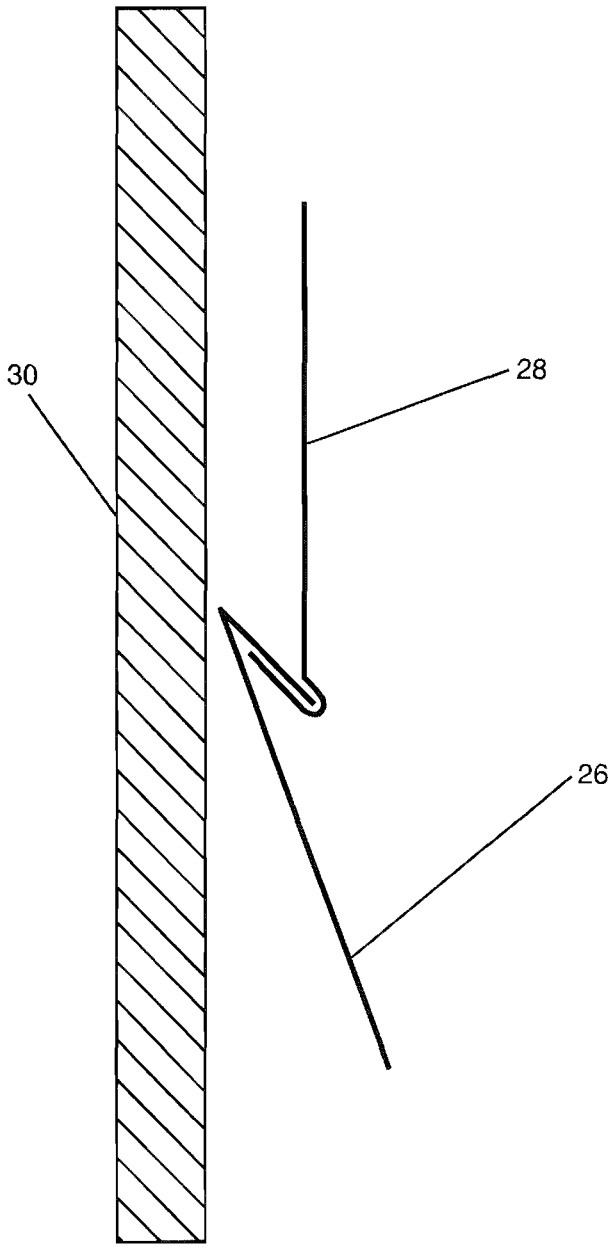
FIG. 7 is a close-up side view illustrating a preferred embodiment of the interconnection between the upper and lower flashing halves.

Referring now to FIGS. 6A-6G, a preferred embodiment of metal flashing 24 is illustrated. As illustrated therein, lower flashing component 26 is preferably fastened to an end portion of sheeting 18. While numerous manners of attachment will become apparent to those skilled in the art upon studying this application, a preferred embodiment of the present invention provides flexible support 14, fastened to substrate 12 via one or more fasteners 20, abutted next to insulating material 16 wherein sheeting 18 is disposed on top of an upper surface of flexible support 14 and wherein waterproofing material 22 is preferably disposed on an upper surface of sheeting 18, substantially above flexible support 14 and wherein a lower end portion of lower flashing component 26 is disposed thereabove. One or more fasteners 20 are most preferably provided which fasten lower flashing component 26 through waterproofing material 22 and sheeting 18 to flexible support 14. Upper flashing component 28 is preferably fastened to wall 30 of a structure which lies near an end portion of sheeting 18. Most preferably, waterproofing material 22 is disposed between wall 30 and an upper end portion of upper flashing component 28. One or more fasteners 20 are preferably used to fasten upper flashing component 28 to waterproofing material 22 to wall 30. In a most preferred embodiment, lower flashing component 26 is preferably slidably connectable to upper flashing component 28. FIG. 7 is a close-up drawing illustrating a preferred interconnection between upper component 28 and lower component 26. Because of the wrap-around connection configuration, not only are the upper and lower portions of metal flashing 24 able to move freely due to thermal expansions and contractions associated with it, the roof, and the wall, but it is also virtually impossible for water to pass therethrough. Accordingly, flashing 24 of the present invention provides a water-resistant seal even when faced with splashes and wind-driven rains.

In one embodiment, a primer is applied to one or more surfaces of the metal components of the present invention before a finishing coating is applied. Although any finishing coating, which can be applied to the one or more metal surfaces and which provides rust resistance, will provide desirable results, a most preferred finishing coating is Valspar Sourcing Inc.'s WEATHERX® coating.

Figure 8:
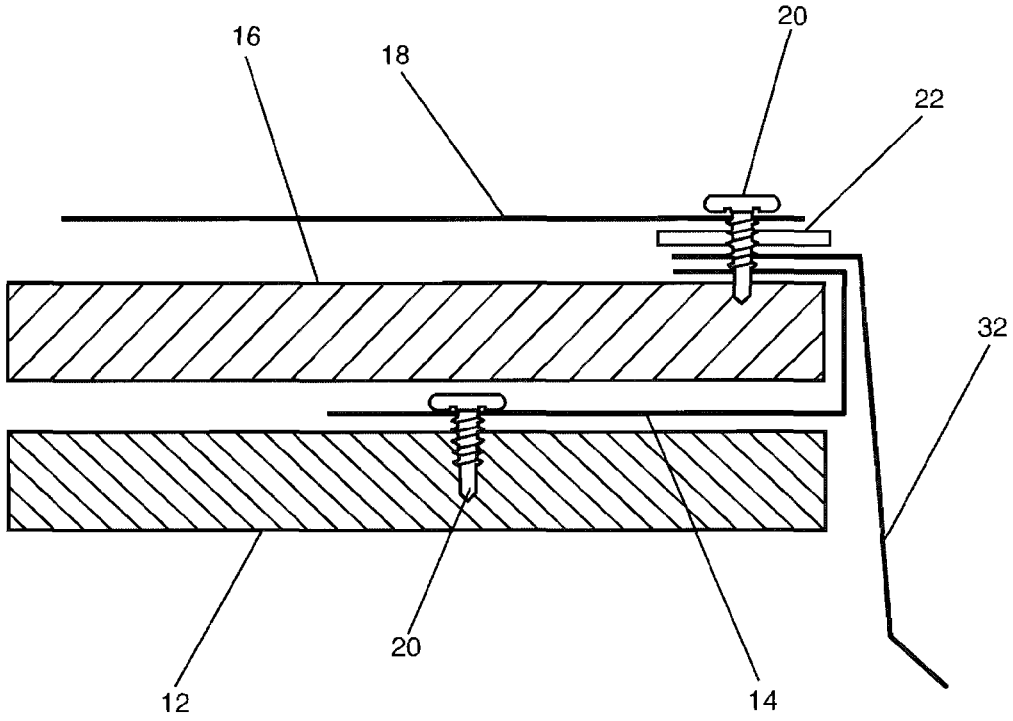
FIG. 8 is a perspective view drawing illustrating an embodiment of the drip edge of the present invention.

FIG. 8 is a drawing illustrating a drip edge according to an embodiment of the present invention. As illustrated therein, near an end portion of roof substrate 12, flexible support 14 is preferably attached thereto with one or more fasteners 20. As illustrated in FIG. 8A, a drip edge of the present invention preferably comprises a j-shaped piece of material for flexible support 14, of course, numerous other shaped pieces of material can be utilized and will produce desirable results as will be recognized by those skilled in the art upon studying this application. Insulating material 16 is preferably disposed atop a lower portion of flexible support 14. Drip strip 32 preferably comprises one or more bends which enable an upper portion of drip strip 34 to be sandwiched between an upper portion of flexible support 14 and weatherproofing material 22. As further illustrated in FIG. 8, sheeting 18 is preferably secured to an upper portion of weatherproofing material 22 via one or more fasteners 20. Fasteners 20 not only secure sheeting 18 and weatherproofing material 22, but also secure an upper portion of flexible support material to an upper portion of drip strip 32.

Figure 9:
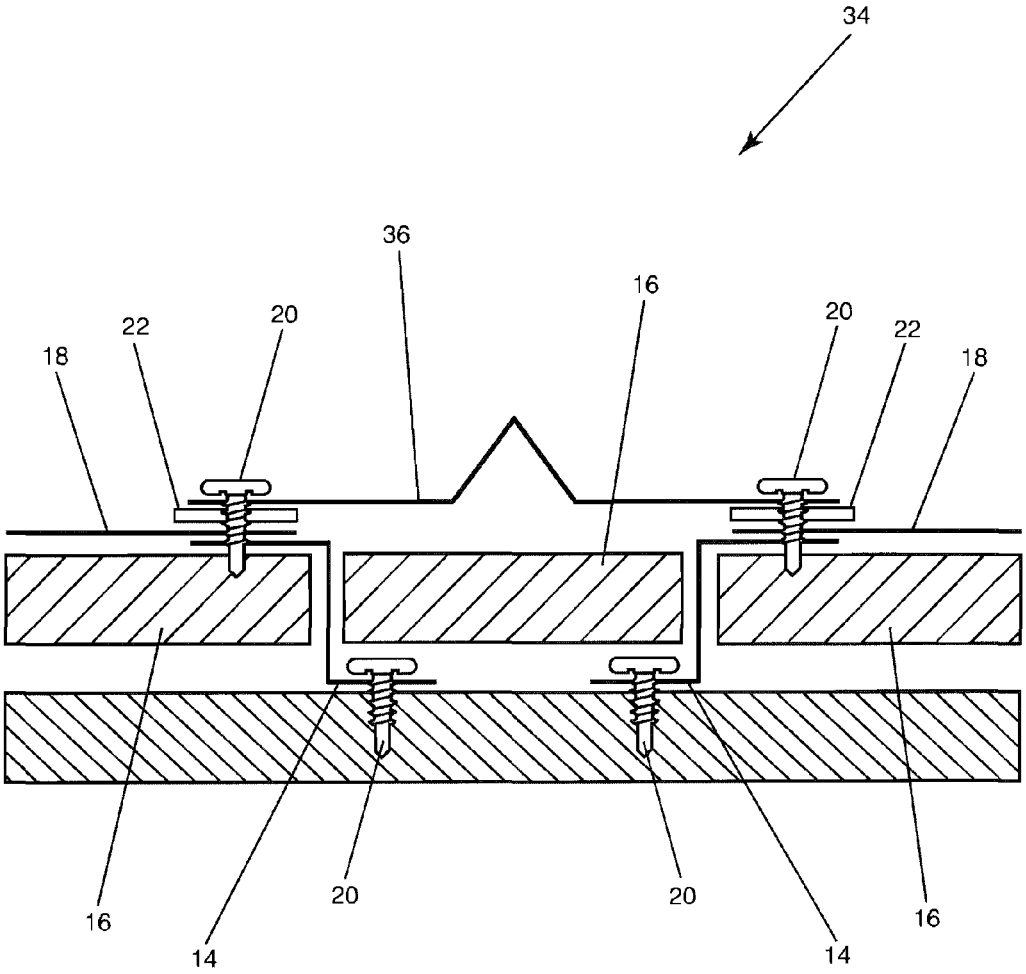
FIG. 9 is a perspective view drawing illustrating an embodiment of an expansion joint of the present invention.
Figure 10:
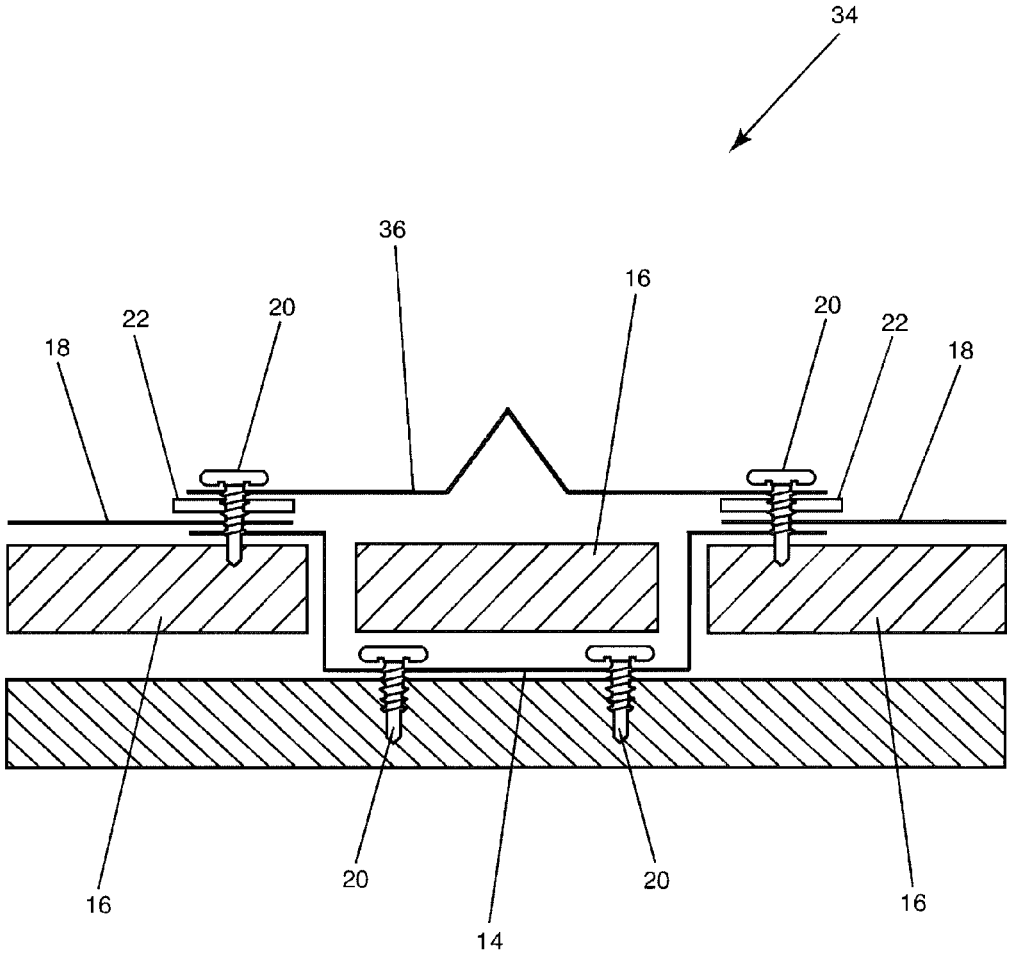
FIG. 10 is a perspective view drawing illustrating an alternative embodiment of an expansion joint of the present invention.

FIGS. 9 and 10 illustrate embodiments of expansion joint 34 of the roofing system of the present invention. Although expansion joints 34 can produce desirable results at virtually any spacing, expansion joints 34 are preferably provided about every 20 to about every 350 feet along roofing substrate 12. Expansion joints 34 are more preferably provided about every 50 feet to about every 200 feet along roofing substrate 12. In a most preferred embodiment, expansion joints 34 are preferably provided about every 100 to about every 150 feet along roofing substrate 12. While FIGS. 9 and 10 illustrate expansion joints comprising particular configurations, those skilled in the art will appreciate that expansion joints can be provided in various shapes, sizes, and configurations and desirable results will still be achieved. As illustrated in the FIGS. 9 and 10, expansion joint 34 is preferably formed by disposing expansion strip 36 between two portions of sheeting 18. Weatherproofing strip 22 is preferably sandwiched between expansion strip 36 and sheeting 18 via one or more fasteners 20. An upper portion of one or more flexible support members 14 is preferably secured to sheeting 18 and expansion strip 36 via one or more fasteners 20. A lower portion of flexible support member 14 is preferably secured to roofing substrate 12 via one or more fasteners 20. As illustrated in the figures, insulating material 16 is preferably disposed on each side of and/or between the one or more flexible support members 14 to which expansion strip 36 is connected. As previously discussed, flexible support members 14 can comprise numerous shapes, as illustrated in FIG. 9, flexible support members 14 comprise a z-shape, while FIG. 10 illustrates flexible support member as comprising an upside-down hat channel.

FIG. 11 illustrates just a handful of the numerous shapes which flexible support members 14 can comprise. As previously mentioned, the shape of the flexible supports of the present are not limited to just those illustrated, but can include any shape which, unlike the hat channel of the prior art (wherein sheeting is attached to a central upper portion of the hat and the legs of the hat are attached to a roofing substrate), can accommodate thermal expansion and contraction of the sheeting of the present invention.

Figure 12:
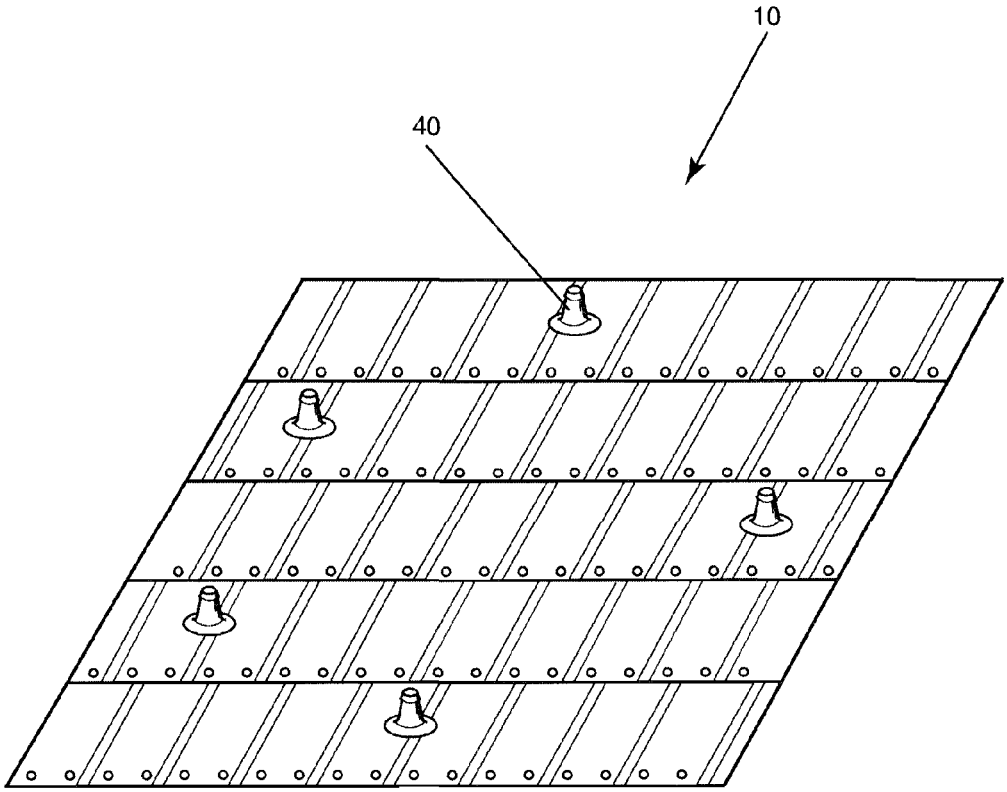
FIG. 12 is a drawing illustrating an embodiment of the roofing system of the present invention wherein a vent is provided.
Figure 13:
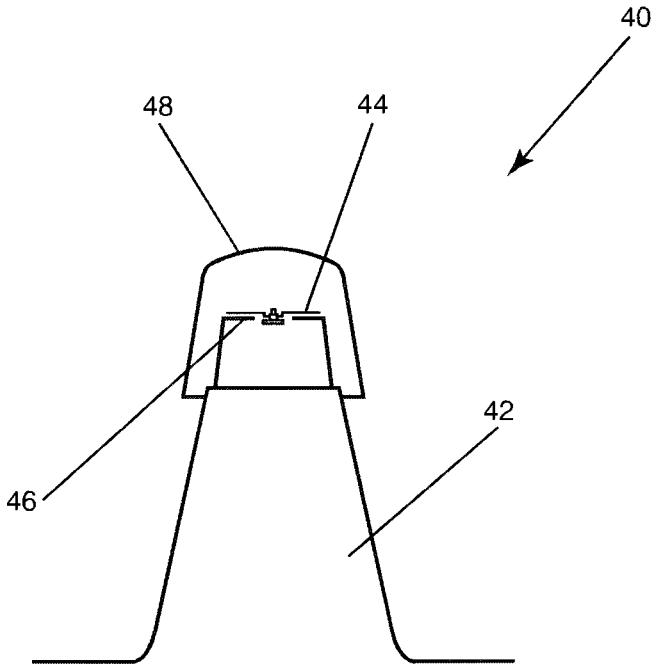
FIG. 13 is a cut-away drawing illustrating an embodiment of the vent of the present invention.

FIG. 12 illustrates an embodiment of the present invention wherein a portion of roofing system 10 comprises vent 40. As best illustrated in the cut-away view drawing of FIG. 13, vent 40 preferably comprises hollow section 42, flap 44, and lip 46, which together form a one-way check valve that allows air to escape through hollow section 42 from the area between roofing substrate 12 and sheeting 18, but which inhibits the flow of air through hollow section 42 into the area between substrate 12 and sheeting 18. Although a particular design of a one-way vent is illustrated, any design of a one-way vent will provide desirable results so long as the one-way vent permits air to escape from beneath sheeting 18 and which most preferably inhibits the flow of air beneath sheeting 18. Accordingly, vent 40 helps keep sheeting 18 in a flattened position and prevents the buildup of air between roofing substrate 12 and sheeting 18 which would tend to cause sheeting 18 to bow upwards and lift away from substrate 12. In order to prevent rain water and other contaminants from passing through hollow section 42 of vent 40, cover 48 is preferably provided above hollow section 42. Although various sizes and spacing of vent 40 can be provided while producing desirable results, in a preferred embodiment, hollow section 42 preferably comprises a cross-sectional area of from about 4 square inches to about 600 square inches and most preferably from about 8 square inches to about 64 square inches and vent 40 is most preferably provided at a spacing of about one for every 500 square feet of sheeting used.

Figure 14A:
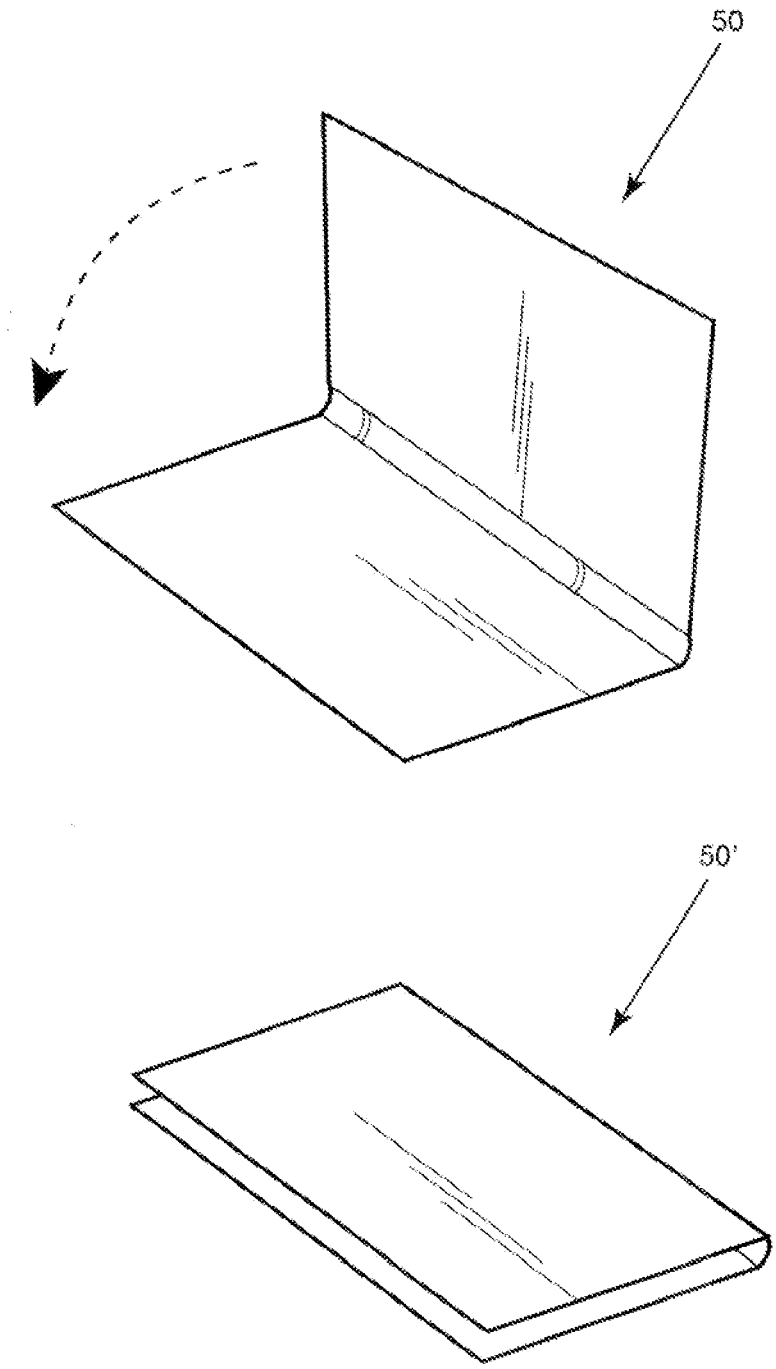
FIG. 14A is a perspective view of alternative embodiments of seam caps according to an aspect of the present invention.
Figure 14B:
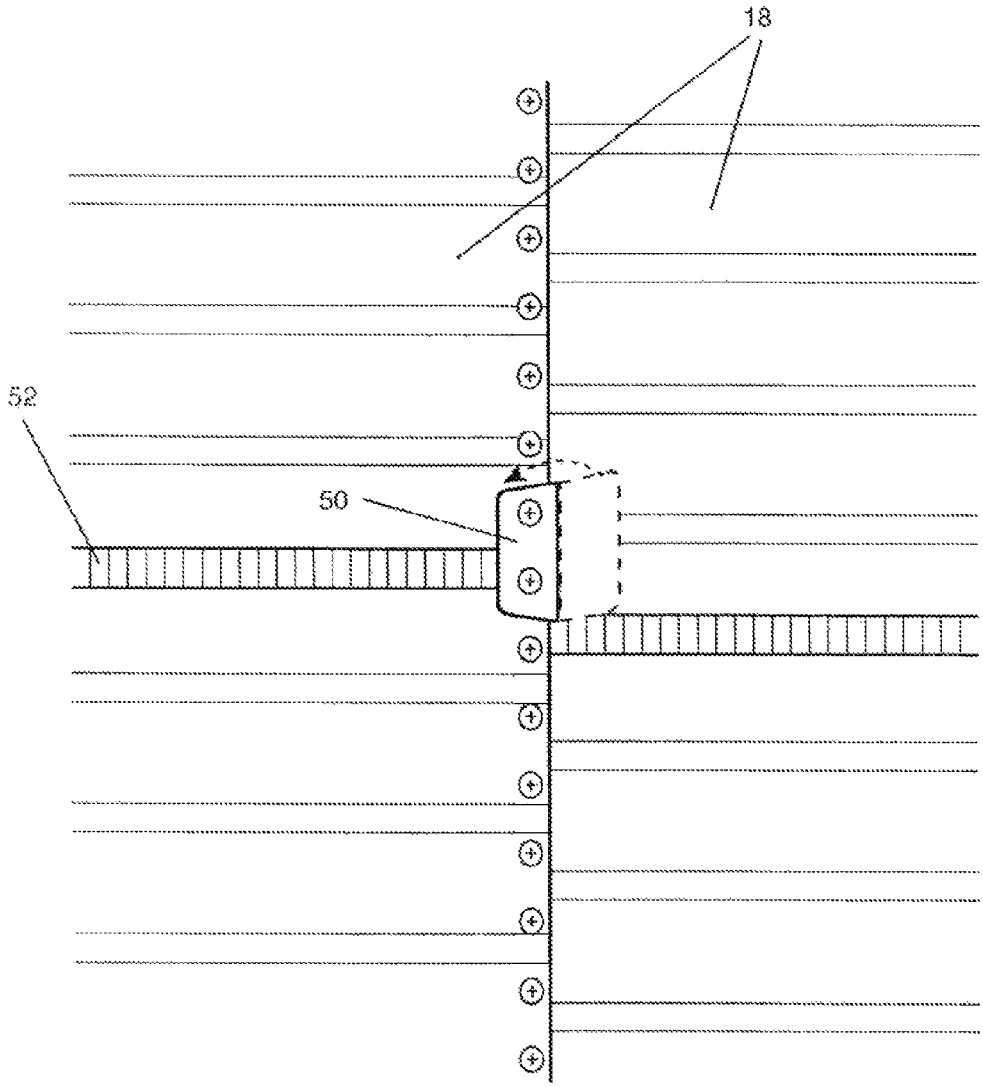
FIGS. 14B and C are perspective view drawings illustrating a roofing system with a seam cap in accordance with an aspect of the present invention.
Figure 14C:
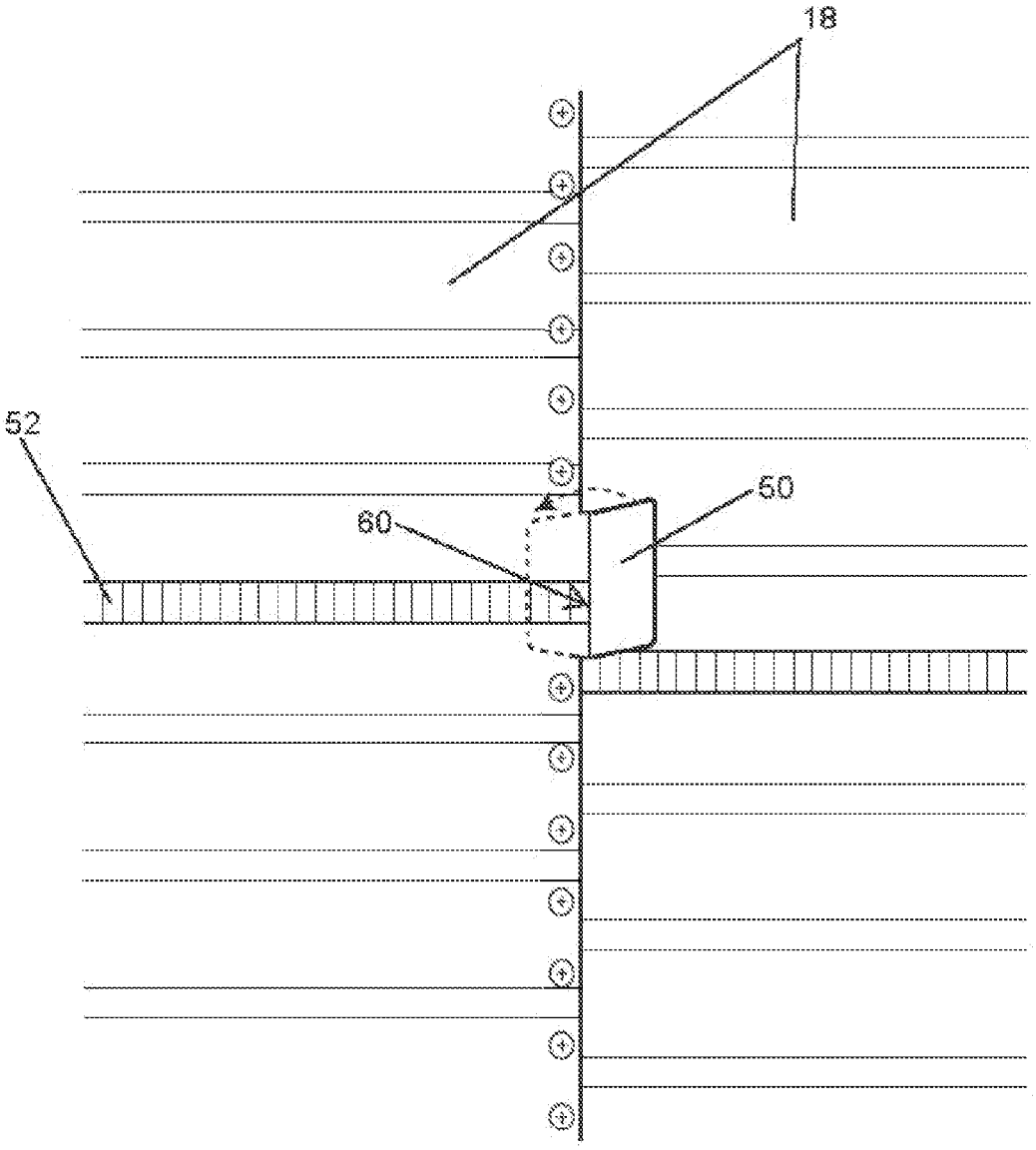

FIGS. 14A-C illustrate seam cap 50 prior to and after installation onto an exposed end portion of seam 52 of sheeting 18 which end portion has been caused to be exposed due to an overlapping joint or another termination of sheeting 18. An exposed end of factory seam 52 can provide an entry point for water within the roofing system of the present invention, which can be wicked along seam 52 of sheeting 18. It is thus desirable to reduce or prevent the exposure of an end of factory seam 52. FIG. 14A illustrates an embodiment of seam cap 50 and its alternative embodiment of seam cap 50'. As illustrated therein, seam cap 50 is most preferably provided in the shape of an angled piece of material, preferably a thin metal material, having a lower portion and an upper portion. Alternatively, seam cap 50' is provided which has a channel shape. In one embodiment, the lower portion of seam cap 50 is preferably slid under sheeting 18 at the termination portion of factory seam 52. A water-proofing calking or another water-proofing material can be disposed over and/or around the exposed end of seam 52 and the remaining upward protruding portion of seam cap 50 is bent over sheeting 18 so as to cover the exposed end of factory seam 52 after which time one or more fasteners can be provided through an upper portion of cap 50, sheeting 18, and lower portion of seam cap 50 at or near seam 52, thus sandwiching the exposed end of seam 52 within the water-proofing calking or other material (see FIGS. 14B and C). In the embodiment of seam cap 50' a water-proofing calking or other waterproofing material is first either disposed on and around a terminal portion of factory seam 52 or is optionally disposed with the channel seam cap 50'. Seam cap 50' is then preferably slid around sheeting 18 at terminal portion 60 of seam 52, thus trapping the exposed end portion of factory seam 52 within water-proofing calking or another waterproofing material and seam cap 50' (see FIGS. 14B and C). The end result achieved when using either seam cap 50 or seam cap 50' is basically the same.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference.

What is claimed is:

1. A single ply roofing system for an existing roofing substrate comprising:

at least one flexible support attached to the roofing substrate;

at least one layer of sheeting, said sheeting attached to said flexible support such that said flexible support flexes when said sheeting thermally expands and/or contracts, and at least a portion of said sheeting comprising a thickness of at least about 26 gauge;

at least one J-shaped member disposed near an end portion of said roofing system, said J-shaped member cupping an end portion of an insulating material;

at least one seam cap disposed over a terminal end-portion of a factory seam of said sheeting;

said insulating material disposed above said roofing substrate and below said sheeting;

a weather-proof calking disposed in said seam cap;

a lower flashing component fastened to an upper surface of said sheeting and an upper flashing component fastened to an at least substantially vertical surface;

said upper and lower flashing components interlock to form a slidable connection therebetween; and a waterproofing material disposed between overlapping portions of said sheeting.

2. The system of claim 1 wherein said insulating materials comprise a thickness of at least 1 inch.

3. The system of claim 1 wherein said sheeting is metal.

4. The system of claim 1 wherein said seam cap is metal.

5. The system of claim 1 further comprising at least one expansion joint.

6. A method of installing a roofing system on a roofing substrate comprising:

attaching at least one flexible support to an upper portion of the roofing substrate;

fastening a portion of a first sheeting at least partially onto an upper portion of the flexible support member;

the first sheeting comprising a thickness of at least 26 gauge;

disposing a portion of a second sheeting at least partially onto an upper surface of the first sheeting;

disposing a waterproofing material between at least some of the overlapping portions of the first and second sheeting;

creating a blind seam by disposing a waterproofing material onto at least a portion of at least one of the flexible supports and attaching sheeting on top of the waterproofing material;

disposing at least one J-shaped member near an end portion of the roofing system such that it cups an end portion of an insulating material;

the insulating material disposed above the roofing substrate and below the first sheeting;

disposing at least one seam cap over a terminal end-portion of a factory seam of at least one of said first or said second sheeting such that said end-portion is sandwiched within said seam cap;

applying one or more coatings of material onto at least a portion of the sheeting; and disposing a weatherproof calking in the seam cap.

7. The method of claim 6 further comprising fastening the lower flashing component to an end portion of the at least one layer of sheeting and fastening the upper flashing component to a wall.

8. The method of claim 7 further comprising slidably connecting the lower flashing component to the upper flashing component.

9. The method of claim 6 further comprising installing at least one expansion joint.

* * * * *